US006920833B2

(12) United States Patent
Lou-Hao

(10) Patent No.: US 6,920,833 B2
(45) Date of Patent: Jul. 26, 2005

(54) BUTTON ACTUATOR FOR USE WITH LEG LOCK OF TABLE

(75) Inventor: Leng Lou-Hao, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 122 days.

(21) Appl. No.: 10/330,792

(22) Filed: Dec. 27, 2002

(65) Prior Publication Data

US 2003/0121460 A1 Jul. 3, 2003

(30) Foreign Application Priority Data

Dec. 29, 2001 (CN) ..... 01280168 U

(51) Int. Cl.[7] ..... A47B 3/00
(52) U.S. Cl. ..... 108/133; 108/132; 248/188.6
(58) Field of Search ..... 108/133, 132, 108/131, 130, 129; 288/188.6, 188.8

(56) References Cited

U.S. PATENT DOCUMENTS

| | | | | |
|---|---|---|---|---|
| 448,380 | A | | 3/1891 | Spangler |
| 1,136,129 | A | | 4/1915 | Haskell |
| 1,675,355 | A | | 7/1928 | King |
| 1,809,564 | A | | 6/1931 | O'Connor et al. |
| 1,833,728 | A | | 11/1931 | Townsend et al. |
| 1,858,534 | A | | 5/1932 | Wood |
| 1,879,945 | A | | 9/1932 | O'Connor |
| 1,905,219 | A | | 4/1933 | Crichton |
| 1,950,862 | A | | 4/1933 | Harman |
| 1,979,568 | A | | 11/1934 | O'Connor et al. |
| RE20,949 | E | | 12/1938 | O'Connor |
| 2,625,454 | A | | 1/1953 | Brown |
| 2,660,498 | A | | 11/1953 | Norquist |
| 2,665,961 | A | | 1/1954 | Anderson |
| 2,680,662 | A | | 6/1954 | Adler |
| 2,730,418 | A | | 1/1956 | Blink |
| 2,921,825 | A | | 1/1960 | Spiegel |
| 3,037,831 | A | | 6/1962 | Craddock et al. |
| 3,072,451 | A | * | 1/1963 | Greenberg et al. ..... 108/160 |
| 3,143,982 | A | | 8/1964 | Blink et al. |
| 3,246,611 | A | * | 4/1966 | Benlian ..... 108/1 |
| 3,416,486 | A | | 12/1968 | Peterson et al. |
| 3,491,706 | A | | 1/1970 | Glass |
| 3,545,738 | A | | 12/1970 | Stagg |
| 3,661,100 | A | | 5/1972 | Tennant |
| 3,744,436 | A | | 7/1973 | Castelli et al. |
| 3,777,675 | A | | 12/1973 | Hanusiak |
| 4,054,096 | A | | 10/1977 | Wilson et al. |
| 4,111,482 | A | | 9/1978 | Jones |
| 4,144,822 | A | | 3/1979 | Roberts et al. |
| 4,238,100 | A | * | 12/1980 | Shy ..... 248/439 |
| 4,442,779 | A | | 4/1984 | Basten et al. |
| 4,557,200 | A | * | 12/1985 | Geschwender ..... 108/132 |
| 4,573,415 | A | * | 3/1986 | Ramey ..... 108/129 |
| 4,838,440 | A | | 6/1989 | Thompson |
| 5,109,778 | A | | 5/1992 | Berkowitz et al. |
| 5,284,100 | A | | 2/1994 | Thorn |
| 5,345,881 | A | * | 9/1994 | Loescher ..... 108/132 |
| 5,357,872 | A | | 10/1994 | Wilmore |
| 5,394,808 | A | | 3/1995 | Dutro et al. |
| 5,540,158 | A | | 7/1996 | Ford |
| 5,623,882 | A | | 4/1997 | Price |
| 5,941,181 | A | | 8/1999 | Hornberger et al. |
| 5,983,807 | A | | 11/1999 | Tarnay et al. |
| 6,032,585 | A | | 3/2000 | Pinch |
| 6,112,674 | A | | 9/2000 | Stanford |
| 6,168,227 | B1 | | 1/2001 | Lofting |
| 6,173,660 | B1 | | 1/2001 | Emmert |
| 6,182,578 | B1 | | 2/2001 | Fanuzzi |
| 6,202,571 | B1 | | 3/2001 | Pallares |
| 6,694,897 | B2 | * | 2/2004 | Lou-Hao ..... 108/132 |

* cited by examiner

*Primary Examiner*—Jose V. Chen
(74) *Attorney, Agent, or Firm*—Barnes & Thornburg LLP

(57) ABSTRACT

A table includes a table top, a leg coupled to the table top for movement relative thereto, and a leg lock. The leg lock includes a button arranged for movement between a locking position locking the leg in a fixed position relative to the table top and an unlocking position allowing movement of the leg relative to the table top. A button actuator is arranged to move the button from the locking position to the unlocking position.

20 Claims, 5 Drawing Sheets

BUTTON ACTUATOR FOR USE WITH LEG LOCK OF TABLE

Foreign priority is hereby claimed under 35 U.S.C. § 119 to Chinese Patent Application No. 01280168.2 filed in the People's Republic of China on Dec. 29, 2001, the disclosure of which is hereby incorporated by reference herein.

BACKGROUND

The present disclosure relates to tables. More particularly, the present disclosure relates to locking and unlocking of legs of tables.

Tables typically include a table top and one or more legs to support the table top. Some tables have legs that can be moved relative to the table top. For example, the legs may be movable to extend from the table top for use of the table and to collapse underneath the table top for storage of the table. There are mechanisms for locking the legs to prevent them from moving relative to the table top.

SUMMARY

According to the present disclosure, a table includes a table top, a leg coupled to the table top for movement relative thereto, and a leg lock. The leg lock includes a button arranged to move between a locking position locking the leg in a fixed position relative to the table top and an unlocking position allowing movement of the leg relative to the table top. A button actuator is arranged to move the button from the locking position to the unlocking position.

The button actuator includes, for example, a flap mount and a flap coupled to the flap mount for pivotable movement relative thereto to engage the button to push the button from the locking position to the unlocking position. The flap mount is, for example, a sleeve surrounding telescoping members of the leg lock. The button actuator may further include a flap retainer coupled to the flap mount to limit movement of the flap relative to the flap mount.

Additional features and advantages of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
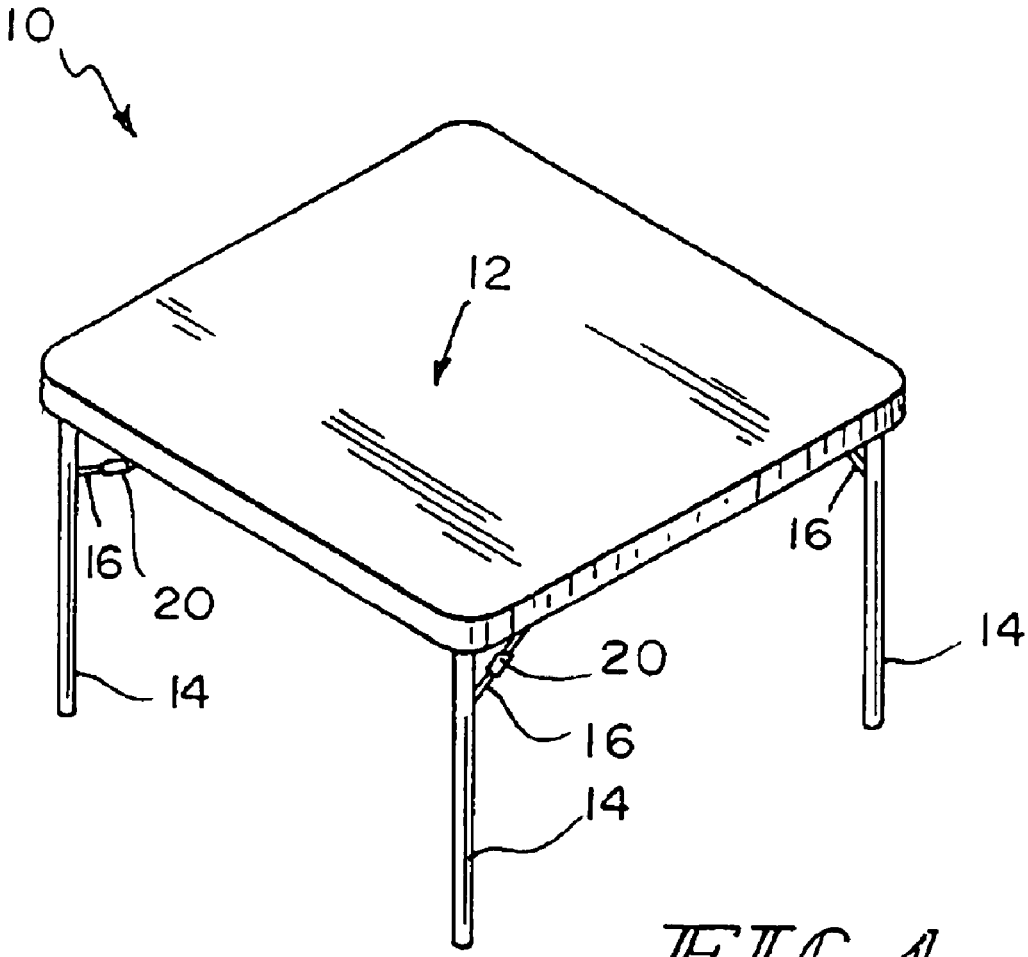
FIG. 1 is a perspective view showing a table including legs held in an extended position by leg locks extending between the legs and a table top.
Figure 2:
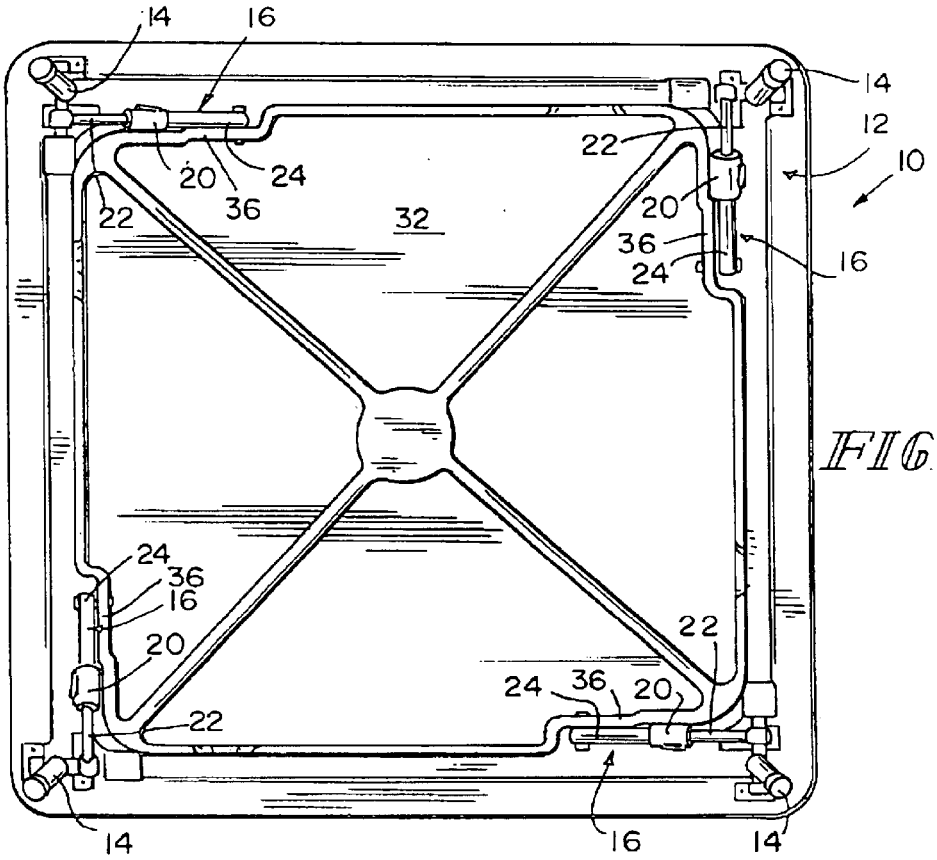
FIG. 2 is a bottom view showing the table with its legs oriented in their extended position by the leg locks.
Figure 3:
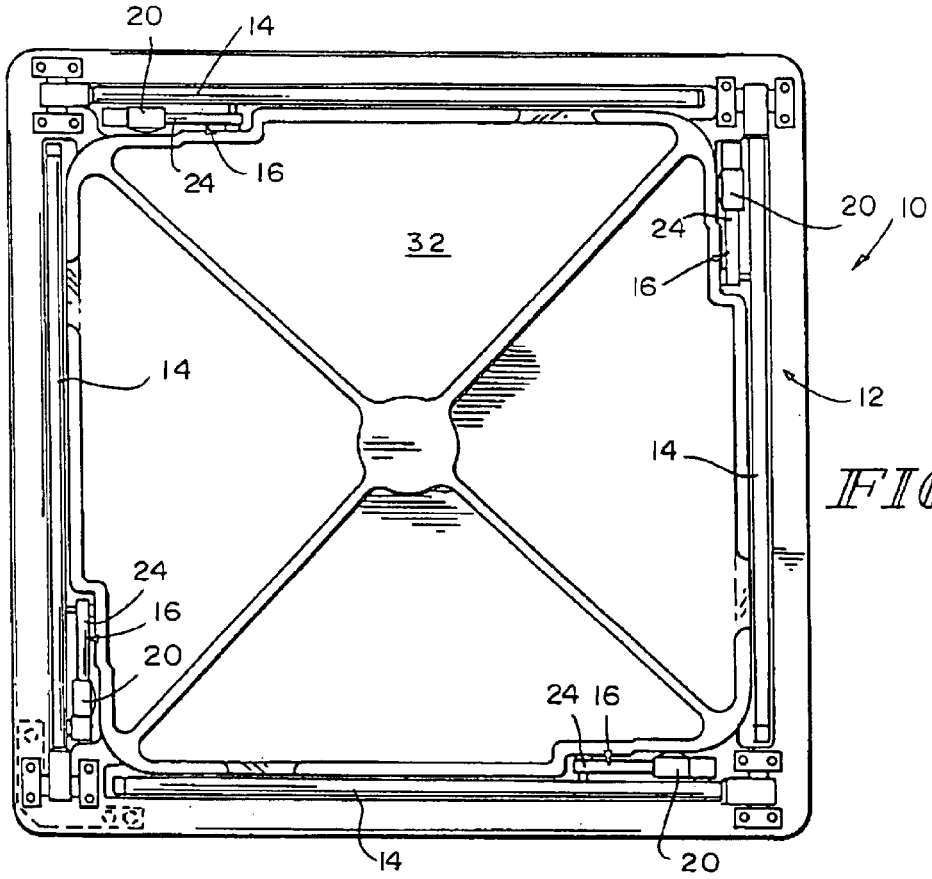
FIG. 3 is a bottom view showing the table with its legs in a collapsed position next to an underside of the table top.
Figure 9:
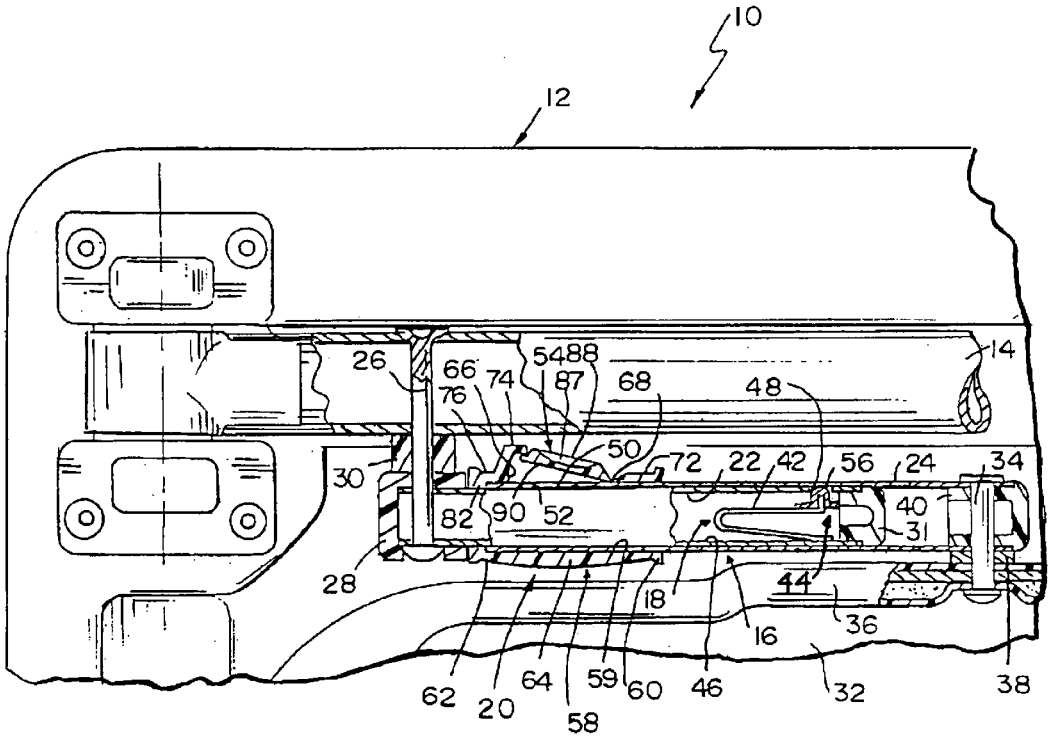
FIG. 9 is bottom view of the table, with portions broken away, showing the outer and inner members oriented in their retracted position and a leg associated with the outer and inner members oriented in its collapsed position.

A table 10 is shown, for example, in FIG. 1. Table 10 includes a table top 12 and a number (e.g., four) of legs 14. Legs 14 are coupled to table top 12 for pivotable movement relative to table top 12 between an extended position, as shown in FIGS. 1, 2, 4, and 5, for use of table 10 and a collapsed position, as shown in FIGS. 3 and 9, for storage of table 10.

A leg lock 16 shown in all Figures is associated with each leg 14 for locking leg 14 in a fixed position relative to table top 12. Each leg lock 16 includes a button 18 (such as the push button shown in FIGS. 5–9) arranged to move between a locking position (see FIG. 5) locking the associated leg 14 in a fixed position relative to table top 12 and an unlocking position (see FIG. 6) allowing movement of leg 14 relative to table top 12. Buttons 18 are, for example, used to lock legs 14 in their extended position. Buttons 18 may, however, be arranged to lock legs 14 in their collapsed position or in some intermediate position between the extended and collapsed positions.

A button actuator 20 is associated with each button 18. Each button actuator 20 is arranged to move the associated button 18 from the locking position to the unlocking position. Button actuator 20 and its relation to the associated leg lock 16 and leg 14 is discussed in more detail herein.

Since legs 14 are similar to one another, leg locks 16 are similar to one another, and button actuators 20 are similar to one another, the discussion herein of only one of each of legs 14, leg locks 16, and button actuators 20 applies to the others as well.

Leg 14 may be coupled to table top 12 for pivotable movement between the extended and collapsed positions in a variety of ways. One way for doing so is disclosed in U.S. application Ser. No. 10/313,177 which was filed Dec. 6, 2002 and is incorporated by reference herein.

Figure 4:
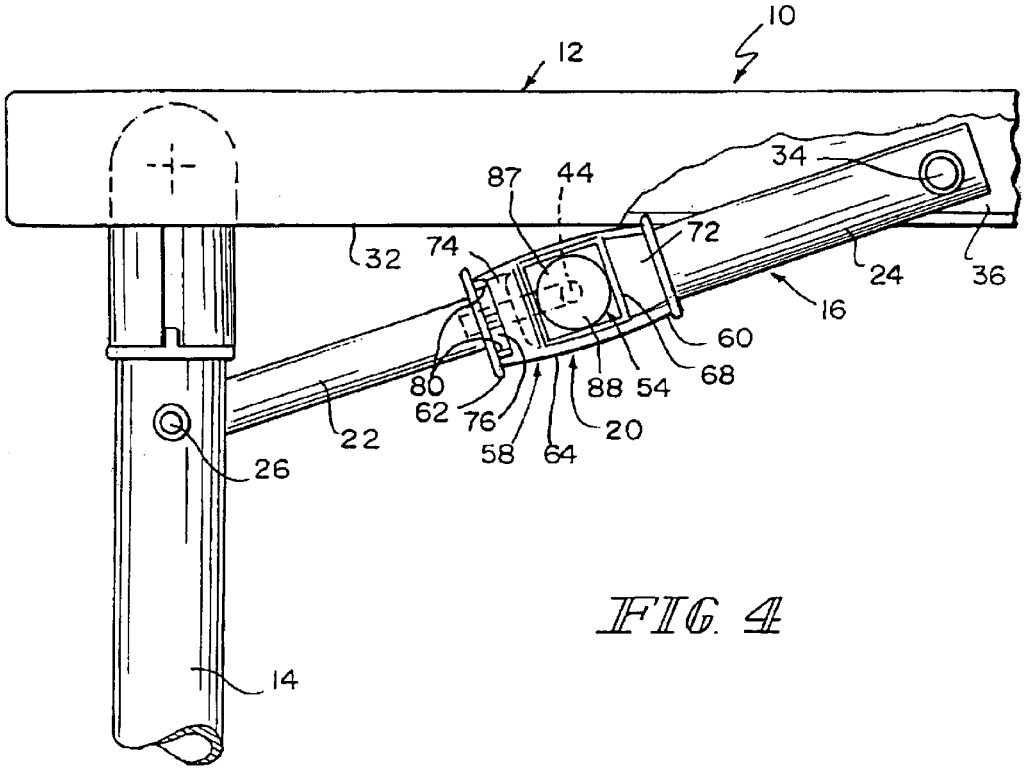
FIG. 4 is an enlarged elevation view showing one of the leg locks orienting a leg in its extended position and a button actuator mounted on the leg lock for actuating a button (represented as a small dashed circle) thereof.
Figure 5:
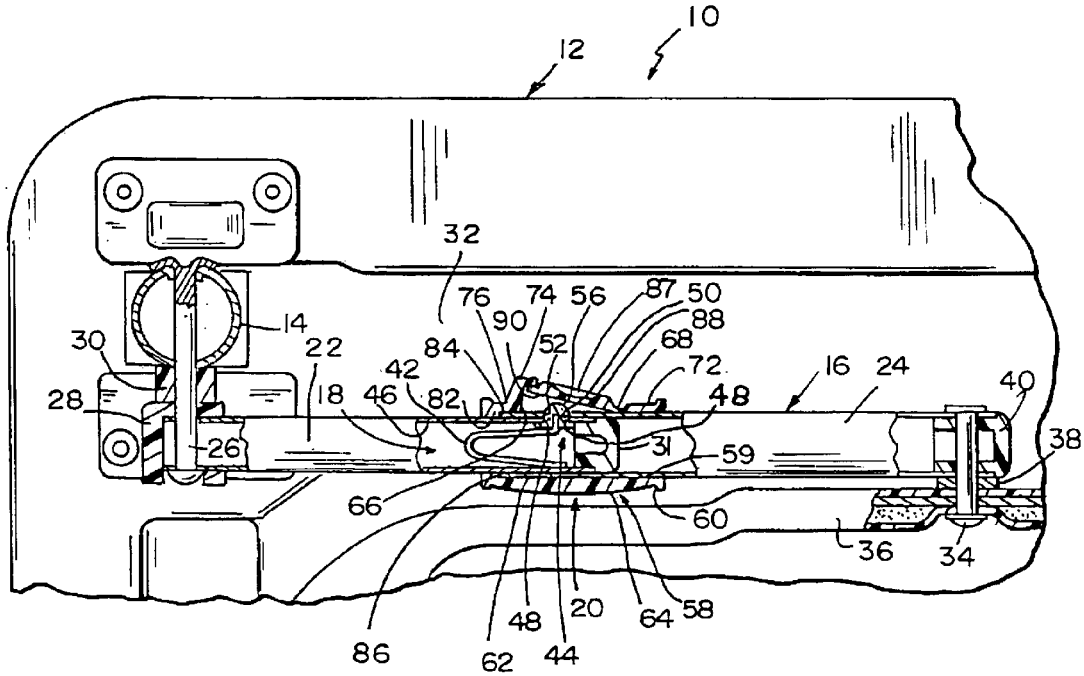
FIG. 5 is a bottom view of the table, with portions broken away, showing a leg lock including telescoping outer and inner members configured, for example, as tubes and a button positioned in a locking position in which the button extends through aligned apertures formed in the outer and inner members to maintain the members in an extended position and thus lock the leg in its extended position and showing a button actuator mounted on the members in close proximity to the button for engagement therewith.
Figure 6:
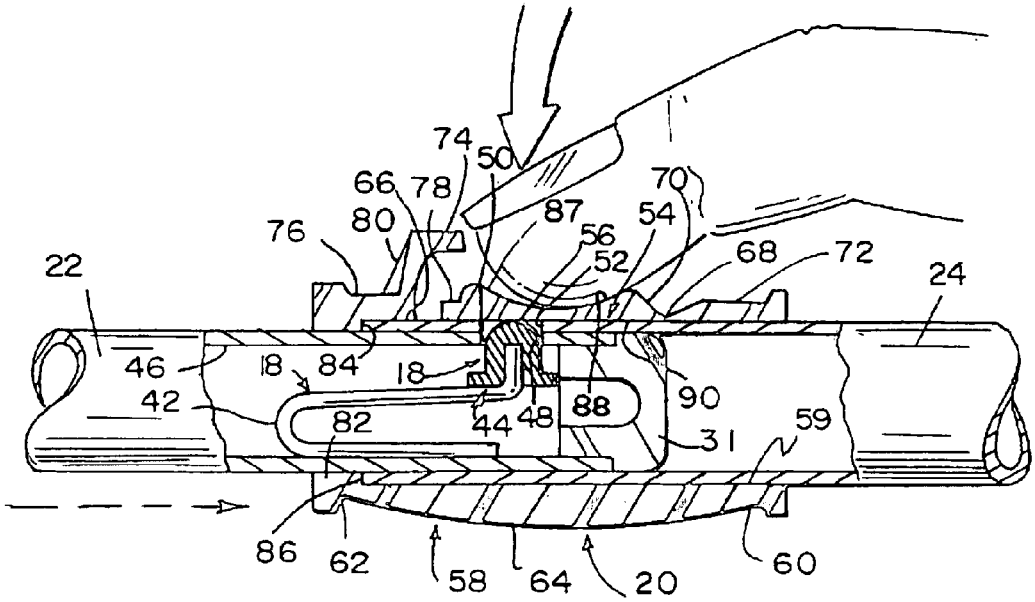
FIG. 6 is an enlarged sectional view showing a flap of the button actuator being pressed against the button to position the button in an unlocking position allowing relative axial movement between the inner and outer members to a retracted position.

Leg lock 16 includes inner and outer telescoping member 22, 24 positioned in telescoping relation to one another, as shown, for example, in FIGS. 4–9. The telescoping members 22, 24 are, for example, telescoping inner and outer tubes, respectively. Instead of being tubes, telescoping members 22, 24 may be non-tubular telescoping inner and outer slide members. The inner and outer telescoping members 22, 24 are movable relative to one another between an extended position in which inner telescoping member 22 extends from outer telescoping member 24, as shown in FIGS. 4–6, to position the leg 14 in its extended position and a retracted position in which inner telescoping member 22 is retracted inside outer telescoping member 24, as shown in FIG. 9, to position leg 16 in its collapsed position.

Member 22 is coupled to leg 14 for pivotable movement relative thereto during pivotable movement of leg 14, as shown best in FIGS. 5 and 9. A pivot pin 26 extends through an end portion of member 22 and a portion of leg 14 to establish the pivotable connection between member 22 and leg 14. A cover 28 covers an opening formed in the end portion of member 22. An annular spacer 30 is positioned between leg 14 and cover 28. A plug 31 is inserted through an opening formed in the other end portion of member 22 to close that opening.

Member 24 is coupled to an underside 32 of table top 12 for pivotable movement relative thereto during pivotable movement of leg 14, as shown best in FIGS. 5 and 9. A pivot pin 34 extends through an end portion of member 24 and a rib 36 formed in underside 32 to establish the pivotable connection between member 24 and table top 12. An annular spacer 38 is positioned between rib 36 and member 24. A plug 40 is inserted through an opening formed in an end portion of member 24 to close the opening.

Button 18 is coupled to member 22, as shown in FIGS. 5–9. Member 22 may thus be referred to as a button mount. Button 18 includes a yieldable biasing element 42 (e.g., a spring) and a locking pin 44. Biasing element 42 is positioned in an interior region 46 formed in member 22 and includes a first end portion engaging an inner surface of member 22 and an opposite, second end portion supporting locking pin 44. Biasing element 42 applies a biasing force to locking pin 44 for yieldably biasing the locking pin 44 radially outwardly into a button-receiving aperture 48 formed in member 22.

Biasing element 42 biases locking pin 44 radially outwardly to the locking position upon movement of members 22, 24 to their extended position, as shown in FIG. 5. Telescoping outer member 24 includes a button trap that takes the form of an aperture-defining edge 50 that defines a locking aperture 52. When members 22, 24 are moved to their extended position and apertures 48, 52 are aligned so that the locking aperture 52 is positioned over button-receiving aperture 48, biasing element 42 biases locking pin 44 radially outwardly to extend through button-receiving aperture 48 and locking aperture 52 to the locking position. In the locking position, locking pin 44 is trapped in the button trap. Stated otherwise, locking pin 44 is surrounded by edge 50 that defines locking aperture 52 for engagement with edge 50 therearound. In this orientation, biasing element 42 and locking pin 44 cooperate to block relative movement between members 22, 24 to lock leg 14 in its extended position.

Figure 7:
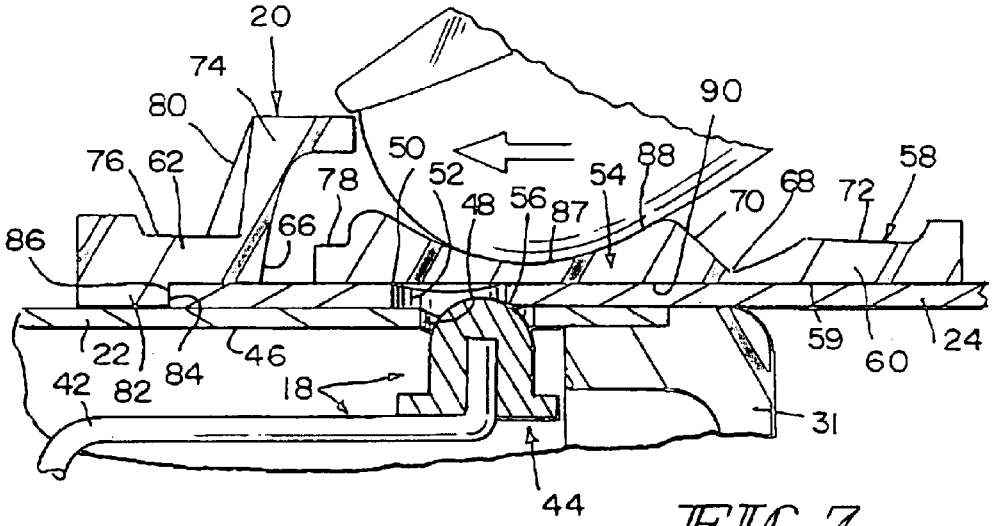
FIG. 7 is a further enlarged sectional view showing the button camming against an aperture-defining edge of the outer member as the members are moved to their retracted position.

Button actuator 20 may be used to push locking pin 44 radially inwardly from the locking position to the unlocking position against the biasing force from biasing element 42, as shown in FIG. 6. Button actuator 20 includes a flap 54 for engaging a hemispherical cam surface 56 of locking pin 44 to push locking pin 44 radially inwardly from the locking position to the unlocking position so that locking pin 44 is withdrawn from locking aperture 52 enough to allow relative axial movement between members 22, 24 for movement of leg 14 relative to the table top 12. In the locking position, cam surface 56 is located outside of and radially outwardly from locking aperture 52. In the unlocking position, cam surface 56 is located inside locking aperture 52 for engagement with edge 50. As members 22, 24 are moved from their extended position to their retracted position, cam surface 56 cams against edge 50 thereby retracting locking pin 44 further radially inwardly out of locking aperture 52 into interior region 46 of inner member 22, as shown in FIG. 7.

Figure 8:
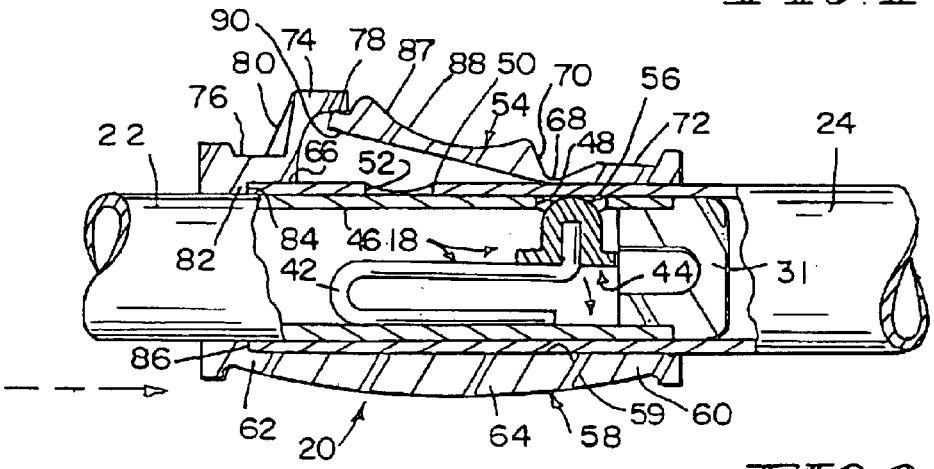
FIG. 8 is a sectional view showing the button actuator traveling with the outer member and the button sliding along an inner surface of the outer member as the members are moved to their retracted position.

Cam surface 56 remains engaged with the inner surface of outer member 24 upon retraction of members 22, 24, as shown in FIGS. 8 and 9. Cam surface 56 slides against an inner surface of outer member 24 upon relative axial movement of members 22, 24 to their retracted position, as shown in FIG. 8. Cam surface 56 continues to remain engaged with the inner surface of outer member 24 when members 22, 24 reach their retracted position, as shown in FIG. 9.

Button actuator 20 further includes a flap mount 58 for mounting flap 54 for movement relative to flap mount 58 to push locking pin 44 radially inwardly from the locking position to the unlocking position, as shown in FIGS. 4-9. Flap mount 58 is configured, for example, as a sleeve formed to include a channel 59 receiving members 22, 24 such that sleeve 58 surrounds members 22, 24.

Sleeve 58 includes an annular first end portion 60, an annular second end portion 62 spaced longitudinally apart from the first end portion 60, and an annular side wall 64 extending longitudinally between first end portion 60 and second end portion 62, as shown in FIGS. 4–9. Side wall 64 is formed to include a button-receiving aperture 66 between end portions 60, 62. Locking pin 44 extends through button-receiving aperture 66 in the locking position. Thus, in the locking position, locking pin 44 extends through both of button-receiving apertures 48, 66 and locking aperture 52.

Flap 54 is coupled to first end portion 60 by a living hinge 68 for pivotable movement of flap 54 relative to sleeve 58, as shown in FIGS. 4–9. In particular, a first side 70 of flap 54 is coupled to a first block portion 72 formed in first end portion 60 by living hinge 68 for pivotable movement of flap 54 relative to sleeve 58.

Button actuator 20 includes a flap retainer 74 for limiting pivotable movement of flap 54 relative to sleeve 58, as shown in FIGS. 5, 8, and 9. In particular, flap retainer 74 is fixed to and extends radially outwardly from a second block portion 76 formed in second end portion 62 so as to extend over and engage a second side 78 of flap 54 to limit pivotable movement of flap 54 relative to sleeve 58. A number (e.g., three) of reinforcing ribs 80 (see FIGS. 4 and 6–8) extend between second block portion 62 and flap retainer 74 to reinforce the connection therebetween. Flap retainer 74 is, for example, L-shaped.

First end portion 60 surrounds outer member 24 and second end portion 62 surrounds inner member 22, as shown in FIGS. 5–9. The inner diameter of first end portion 60 is greater than an inner diameter of second end portion 62. The inner diameter of second end portion 62 is greater than an outer diameter of inner member 22.

The portion of channel 59 at second end portion 62 includes a radially inwardly extending shoulder 82, as shown in FIGS. 5-9. Shoulder 82 includes an axially facing surface 84 for engagement with an end edge 86 of outer member 24. End edge 86 engages surface 84 to push button actuator 20 axially along inner member 22 upon relative axial movement between members 22, 24 from their extended position to their retracted position.

Button actuator 20 is arranged to move button 18 from the locking position to the unlocking position, as shown in FIG. 6. To do so, a user presses radially inwardly on a recessed portion 87 formed in an outer surface 88 of flap 54 thereby causing an inner surface 90 of flap 54 to engage cam surface 56 and move locking pin 44 radially inwardly against the biasing force of biasing element 42 from the locking position to the unlocking position.

It is more comfortable for at least some users to press directly on flap 54 than directly on locking pin 44. Outer surface 88 provides a greater surface area than cam surface 56 for a finger of a user to engage. As such, flap 54 distributes the biasing force from biasing element 42 more evenly and thus more comfortably across the user's finger than would cam surface 56. Further, use of flap 54 avoids possible pinching of the user's finger between cam surface 56 and edge 50 upon relative movement between members 22, 24.

What is claimed is:

1. A table comprising:

a table top, a leg coupled to the table top for movement relative thereto, a leg lock coupled to the table top and the leg, the leg lock including an inner tube, an outer tube, and a button, the inner tube and the outer tube being positioned in telescoping relation to one another, the button being movable between a locking position in which the button extends from the inner tube through a locking aperture formed in the outer tube to block relative movement between the inner tube and the outer tube to lock the leg in a fixed position relative to the table top and an unlocking position in which the button is withdrawn from the locking aperture into the inner tube enough to allow relative movement between the inner tube and the outer tube for movement of the leg relative to the table top, and a button actuator including a sleeve and a flap, the sleeve surrounding the inner tube and the outer tube, the flap being coupled to the sleeve for movement relative thereto to move the button from the locking position to the unlocking position.

2. The table of claim 1, wherein the sleeve includes a first end portion and a second end portion spaced longitudinally from the first end portion, the first end portion surrounds the outer tube and has a first inner diameter, and the second end portion surrounds the inner tube and a has a second inner diameter that is smaller than the first inner diameter and greater than an outer diameter of the inner tube.

3. The table of claim 1, wherein the sleeve includes a first end portion, a second end portion spaced longitudinally from the first end portion, and a side wall extending longitudinally between the first and second end portions, the side wall is formed to include a first button-receiving aperture, and the button extends through the first button-receiving aperture, the locking aperture, and a second button-receiving aperture formed in the inner tube when the button is positioned in the locking position.

4. The table of claim 3, wherein a first side of the flap is coupled to the first end portion of the sleeve by a living hinge for pivotable movement of the flap relative to the sleeve, and the button actuator includes a button retainer extending outwardly from the second end portion of the sleeve over a second side of the flap for engagement therewith to limit pivotable movement of the flap relative to the sleeve.

5. The table of claim 1, wherein the sleeve includes a channel receiving the inner tube and the outer tube, the channel includes a radially inwardly extending shoulder including an axially facing surface, and the outer tube includes an end edge arranged to engage the axially facing surface to move the button actuator axially along the inner tube upon relative movement between the inner tube and the outer tube.

6. The table of claim 1, wherein the button actuator includes a flap retainer coupled to the sleeve and extending over the flap for engagement therewith to limit movement of the flap relative to the sleeve.

7. A table comprising:

a table top, a leg coupled to the table top for movement relative thereto;

a leg lock coupled to the table top and the leg, the leg lock including a button and telescoping members positioned in telescoping relation to one another, the button being arranged to move relative to the telescoping members between a locking position blocking relative movement between the telescoping members to lock the leg in a fixed position relative to the table top and an unlocking position allowing relative movement between the telescoping members for movement of the leg relative to the table top, and means for moving the button from the locking position to the unlocking position.

8. The table of claim 7, wherein the telescoping members include an outer tube and an inner tube inside the outer tube, the button includes a locking pin movable in a button-receiving aperture formed in the inner tube and a biasing element positioned in an interior region formed in the inner tube and arranged to bias yieldably the locking pin to the locking position so as to extend from the interior region through the button-receiving aperture into a locking aperture formed in the outer tube, and the button moving means is coupled to at least one of the outer tube and the inner tube and arranged to engage the locking pin to push the locking pin through the locking aperture and the button-receiving aperture to retract the locking pin into the interior region to the unlocking position against a biasing force applied by the biasing element.

9. The table of claim 8, wherein the button moving means includes a flap mount surrounding the outer tube and the inner tube and a flap coupled to the flap mount for movement relative thereto to engage the locking pin to move the locking pin from the locking position to the unlocking position.

10. The table of claim 9, wherein the outer tube includes an aperture-defining edge that defines the locking aperture, the locking pin includes a cam surface, and the flap is arranged to engage the cam surface to push the cam surface into the locking aperture to allow the cam surface to cam against the aperture-defining edge to retract the locking pin further into the interior region upon relative axial movement between the outer tube and the inner tube.

11. The table of claim 7, wherein the button moving means includes a sleeve that surrounds the telescoping members and a flap coupled to the sleeve for movement relative thereto to engage the button to move the button from the locking position to the unlocking position.

12. The table of claim 7, wherein the button moving means includes a flap mount coupled to the leg lock, a flap coupled to the flap mount for movement relative thereto to engage the button to move the button from the locking position to the unlocking position, and a flap retainer coupled to the flap mount for engagement with the flap to limit movement of the flap relative to the flap mount.

13. A table comprising:

a table top, a leg coupled to the table top for movement relative thereto, a leg lock coupled to the table top and the leg, the leg lock including a button, a button mount to which the button is coupled, and a button trap, the button mount and the button trap being arranged to move relative to one another, the button being arranged to move between a locking position in which the button is trapped in the button trap to block relative movement between the button mount and the button trap to lock the leg in a fixed position relative to the table top and an unlocking position in which the button is withdrawn from the button trap enough to allow relative movement between the button mount and the button trap for movement of the leg relative to the table top, and a button actuator arranged to move the button from the locking position to the unlocking position.

14. The table of claim 13, wherein the leg lock includes an inner tube and an outer tube, the inner and outer tubes are positioned in telescoping relation, the inner tube is the button mount and is formed to include a first button-receiving aperture, the outer tube includes the button trap which is an aperture-defining edge defining a locking aperture, the button includes a locking pin and a biasing element positioned in an interior region of the inner tube and arranged to bias yieldably the locking pin to the locking position so as to extend through the first button-receiving aperture into the locking aperture, and the button actuator includes a sleeve surrounding the inner tube and the outer tube and a flap coupled to the sleeve and arranged to move relative to the flap for engagement with the locking pin to push the locking pin through the locking aperture to the unlocking position against a biasing force applied by the biasing element.

15. The table of claim 14, wherein the sleeve includes a first end portion, a second end portion spaced longitudinally apart from the first end portion, and a side wall extending longitudinally between the first end portion and the second end portion, and the side wall is formed to include a second button-receiving aperture through which the locking pin extends when the locking pin is positioned in the locking position.

16. The table of claim 15, wherein the first end portion surrounds the outer tube and has a first inner diameter, the second end portion surrounds the inner tube and a has a second inner diameter that is smaller than the first inner diameter and greater than an outer diameter of the inner tube.

17. The table of claim 14, wherein the sleeve includes a channel receiving the inner tube and the outer tube, the channel includes a shoulder, and the outer tube includes an end edge arranged to engage the shoulder to move the button actuator axially along the inner tube upon relative axial movement between the outer tube and the inner tube.

18. The table of claim 13, wherein the leg lock includes inner and outer telescoping members positioned in telescoping relation to one another, the inner telescoping member is the button mount, the outer telescoping member includes the button trap, the button actuator includes a sleeve surrounding the inner and outer telescoping members and a flap coupled to the sleeve for pivotable movement relative thereto to engage the button to move the button from the locking position to the unlocking position.

19. The table of claim 18, wherein the sleeve includes a first end portion, a second end portion spaced longitudinally apart from the first end portion, and a side wall extending longitudinally between the first end portion and the second end portion and the side wall is formed to include a button-receiving aperture through which the button extends when the button is positioned in the locking position.

20. The table of claim 19, wherein the flap is coupled to the first end portion of the sleeve by a living hinge, and the button actuator includes a flap retainer extending outwardly from the second end portion of the sleeve for engagement with the flap to limit movement of the flap relative to the sleeve.

* * * * *